US006809702B2

(12) United States Patent
Safakhah

(10) Patent No.: US 6,809,702 B2
(45) Date of Patent: Oct. 26, 2004

(54) RELAY ANTENNA MASTS FOR CELLULAR RADIO-TELECOMMUNICATION SYSTEM

(75) Inventor: Hossein Safakhah, Orsay (FR)

(73) Assignee: Bouygues Telecom, Velizy-Villacoublay (FR)

( * ) Notice: Subject to any disclaimer, the term of this patent is extended or adjusted under 35 U.S.C. 154(b) by 0 days.

(21) Appl. No.: 10/019,878

(22) PCT Filed: Apr. 25, 2001

(86) PCT No.: PCT/FR01/01260

§ 371 (c)(1),
(2), (4) Date: May 2, 2002

(87) PCT Pub. No.: WO01/82406

PCT Pub. Date: Nov. 1, 2001

(65) Prior Publication Data

US 2002/0149536 A1 Oct. 17, 2002

(30) Foreign Application Priority Data

Apr. 25, 2000 (FR) ..... 00 05242

(51) Int. Cl.[7] ..... H01Q 1/12
(52) U.S. Cl. ..... 343/890; 343/880
(58) Field of Search ..... 343/890, 891, 343/880, 881, 882, 888, 892; H01Q 1/12

(56) References Cited

U.S. PATENT DOCUMENTS 4,151,534 A * 4/1979 Bond ..... 343/883
4,167,740 A * 9/1979 Shriver ..... 343/882

FOREIGN PATENT DOCUMENTS

FR 2684127 * 5/1993 ..... E04H/12/18

* cited by examiner

*Primary Examiner*—Hoanganh Le
(74) *Attorney, Agent, or Firm*—Blakely Sokoloff Taylor & Zafman

(57) ABSTRACT

A relay antenna mast for a cellular radio telecommunications system, the mast being characterized in that it comprises:

a mast stand (1);

at least one arm (3) pivotally mounted on said mast stand (1) and carrying at least one antenna (5); and means for locking said arm in a position in which the antenna(s) is/are in a high position;

said arm (3) being suitable, when said locking means are disengaged, for being tilted about its pivot axis (4) to a position in which at least one antenna is at a height enabling it to be worked on by an operative at the foot of the mast.

9 Claims, 5 Drawing Sheets

RELAY ANTENNA MASTS FOR CELLULAR RADIO-TELECOMMUNICATION SYSTEM

This is a non-provisional application claiming the benefit of international application number PCT/FR01/01260 filed Apr. 25, 2001.

GENERAL FIELD OF THE INVENTION AND STATE OF THE ART

The present invention relates to relay antenna masts for cellular radio telecommunications systems.

Conventionally, in urban areas, relay antenna masts are installed on high sites such as the tops of buildings, and they can be located at heights of up to 40 meters, or even more.

It is necessary to be able to work regularly on the antennas carried by such masts, in order to perform maintenance and also to adjust their pointing in elevation and in azimuth.

Because of the height of antennas on a mast, and because of the need to have access to the antennas, operatives are frequently exposed to the danger of falling.

For reasons associated particularly with questions of size and appearance, it is difficult to envisage providing guard rails extending up the full height of such masts so as to make it quite safe to work on them.

There thus exists a need for a solution capable of ensuring that work on antennas installed at the ends of such masts is made quite safe.

Radio amateur antenna masts are already known which are of the tilting type. In this respect, reference can be made in particular to U.S. Pat. No. 4,167,740.

Nevertheless, radio amateur antennas constitute a technical field which is different from that of antennas for cellular communications.

SUMMARY OF THE INVENTION

The invention provides an antenna mast enabling the above requirements to be satisfied.

The solution proposed by the invention presents the advantage of being particularly simple, of not requiring maintenance, of being adapted to being installed out of doors, and to withstanding bad weather.

Because of its simplicity, intensive use does not lead to abnormal wear.

Furthermore, operatives no longer need to climb to the top of the masts to work on the antennas, so it is no longer necessary to provide steps or anchor points up the masts, and the equipment required by operatives is greatly simplified (no harness, tethers, etc.). Furthermore, the absence of steps on the mast means that it fits in well with its environment.

The solution proposed by the invention is a relay antenna mast for a cellular radio telecommunications system, the mast being characterized in that it comprises:

a mast stand;

at least one arm pivotally mounted on said mast stand and carrying at least one antenna; and means for locking said arm in a position in which the antenna(s) is/are in a high position;

said arm being suitable, when said locking means are disengaged, for being tilted about its pivot axis to a position in which at least one antenna is at a height enabling it to be worked on by an operative at the foot of the mast.

Such a mast is also advantageously associated with the various characteristics below taken singly or in any technically feasible combination:

in a first variant, the arm extends on either side of its pivot axis and carries counterweight-forming means on its branch opposite from its branch carrying the antenna(s);

the counterweight-forming means are adjustable in mass and/or in translation along the arm;

in another variant, it includes a linkage comprising two elements fixed one to the mast stand and the other to the arm, one of the elements carrying means for fixing a retaining device enabling the operative to control tilting of the arm;

the retaining device is a removable device put into place by the operative prior to releasing the locking means, and subsequently removed once the locking means have been re-engaged after work has been carried out;

it comprises a plurality of arms pivotally mounted on a common mast stand; and an arm carries a plurality of antennas.

The invention also provides a platform for a relay antenna mast in a cellular radio telecommunications system for use in an urban area, the platform comprising a relay antenna mast and a protective guard rail, and being characterized in that the antenna mast is a mast of the above-specified type.

In particular, the antenna mast and the guard rail are carried on the top of a building.

The invention also provides the use of a tilting antenna mast to carry at least one relay antenna in a cellular radio telecommunications system.

DESCRIPTION OF THE FIGURES

Other characteristics and advantages of the invention appear further from the following description which is purely illustrative and non-limiting and should be read with reference to the accompanying drawings, in which.

DETAILED DESCRIPTION OF EMBODIMENTS

Antenna Mast with Counterweight

Figure 1:
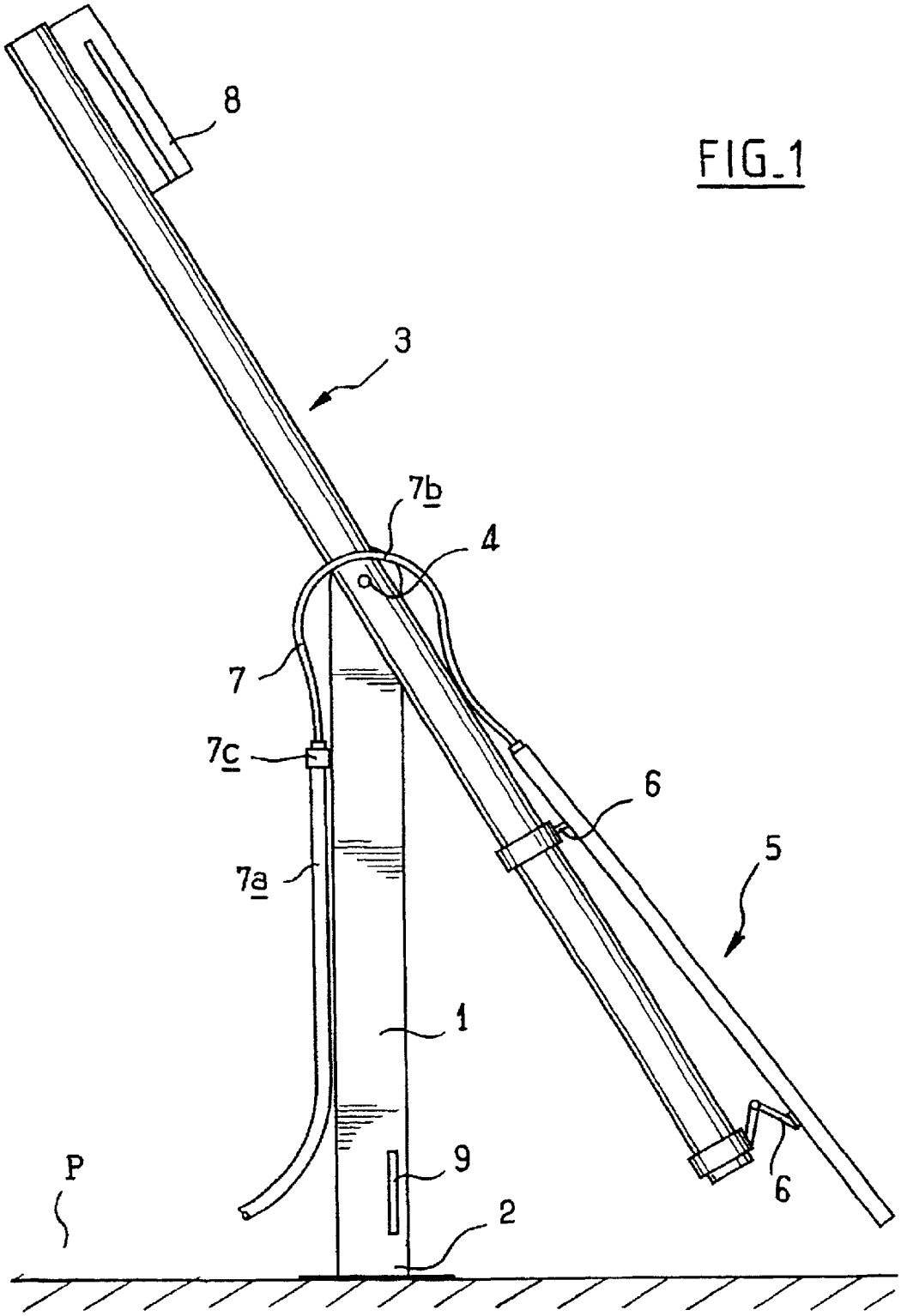
FIG. 1 is a diagrammatic side view of a mast with an adjustable counterweight arm constituting one possible embodiment of the invention.
Figure 2:
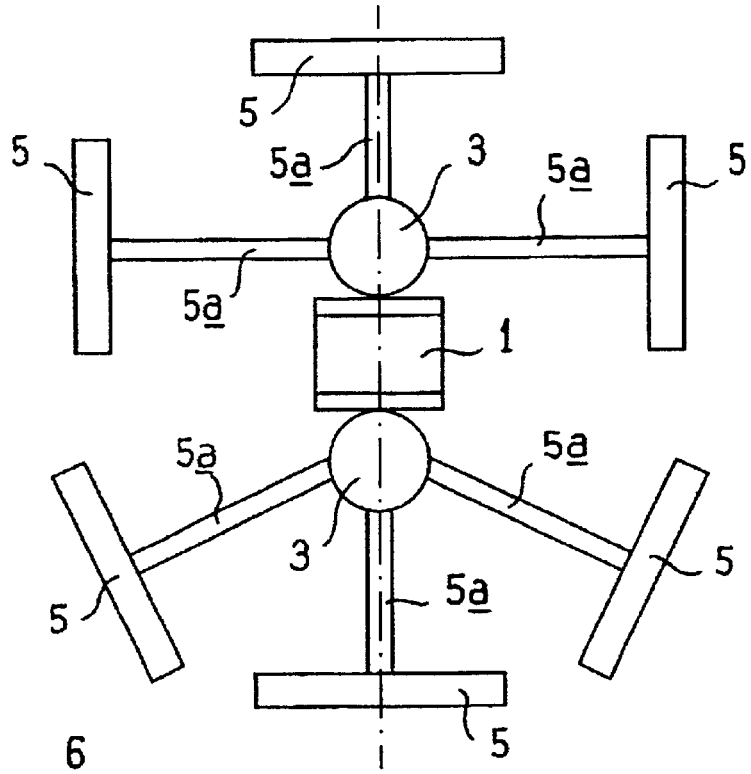
FIG. 2 is a diagrammatic plan view of a structure suitable for carrying six antennas and using the embodiment shown in FIG. 1.

The antenna mast structure that is shown in FIGS. 1 and 2 comprises a stand 1 which extends vertically from a sole plate for fixing to a platform P, which can be constituted, for example, by the flat roof of a building, by means of a metal block, a slab, or an equivalent support to which it is fastened.

The antenna mast has at least one arm 3 pivotally mounted about a horizontal axis 4 at the top of the vertical stand 1 remote from the platform P.

The arm 3 extends on both sides of the axis 4.

One of its branches carries one or more relay antennas 5.

The relay antenna(s) 5 is/are fixed to said arm 3 by connection means 6 which are themselves conventional and enable the antenna to be adjusted in elevation and in azimuth.

An antenna downlead 7*a* extends along the stand of the mast.

Such an antenna downlead 7*a* is connected to an antenna 5 via a flexible coaxial link 7*b*.

The connection, referenced 7*c*, between the antenna downlead 7*a* and the link 7*b* is at a height that is accessible for an operative standing on the platform P.

Because of its loop shape and its flexibility, the coaxial link 7*b* is suitable for following the pivoting movements of the arm without being damaged.

It should be understood, as shown in FIG. 2, that a plurality of arms 3 can be hinged to pivot relative to a common stand 1, and each arm 3 can carry a plurality of antennas 5 on spars 5*a*.

In the example of FIG. 2, two arms 3 are mounted symmetrically on opposite sides of a common stand 1. Each carries three antennas 5.

Figure 3A:
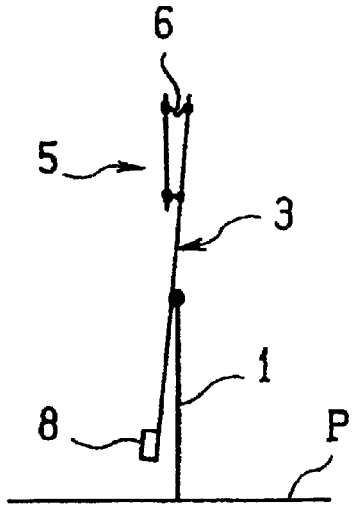
FIGS. 3*a* to 3*c* are diagrams showing how a mast of the type shown in FIG. 1 is used.

In the in-use position (FIG. 3*a*), an arm 3 carrying one or more antennas 5 is locked relative to the stand 1 on which it is mounted so as to occupy a vertical position in which it extends said stand 1.

Locking means are provided for this purpose which are constituted by a fork (not shown) which is passed over the arm(s) 3 and the vertical stand 1, with one branch of said fork being inserted in a complementary housing 9 provided in the stand 1 for receiving it, and said fork then being closed by bolt/pin type means suitable for being installed on the ends of the branches of the fork.

With reference again to FIG. 1, it can be seen that at its end remote from the antenna(s) 5, an arm 3 carries counterweight-forming means 8 selected so as to ensure that the two branches of said arm 3 on opposite sides of the axis 4 are substantially in equilibrium.

The counterweight-forming means 8 can be constituted by plates of lead engaged on a threaded rod, for example, with the number of plates and the position of the set of plates along the arm being adjustable.

The equilibrium provided by said counterweight-forming means makes an arm 3 easier to tilt.

In particular, when an operative seeks to work on an antenna 5, it suffices to release the means locking said arm 3 in its vertical position relative to the stand 1, and where appropriate to exert a small amount of torque on the arm tending to cause it to tilt.

Given that the two branches of the arm are substantially in equilibrium, tilting is very easy to achieve.

It is particularly easy to achieve if the counterweight is adjusted in such a manner that the torque it exerts on the arm 3 is slightly smaller than the torque exerted by the antenna (s).

Figure 3B:
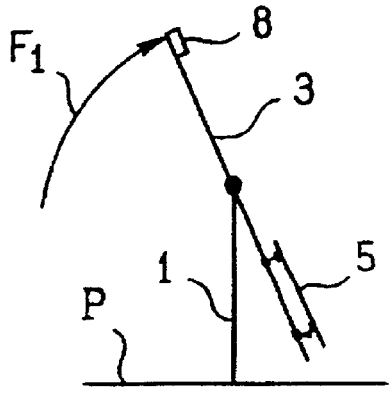

Once the means for locking the arm 3 in its vertical position has been disengaged, the arm 3 tilts without the user needing to apply any force (tilting represented by arrow F in FIG. 3*b*).

After the arm 3 has tilted, the antenna(s) 5 is/are located at a height that allows the operative to work thereon in complete safety.

Figure 3C:
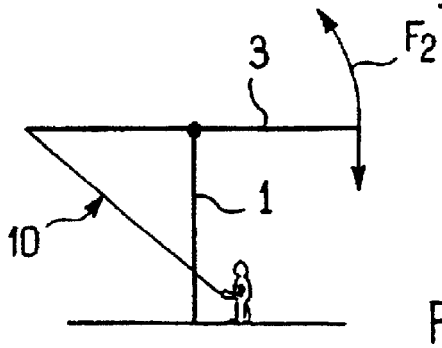

Furthermore, as shown in FIG. 3*c*, fixing means (e.g. a hook) are provided at the end of the arm 3 remote from the antenna(s) 5 suitable for securing a cord 10.

By pulling on the cord 10, the user tilts the arm 3 in the opposite direction to its initial tilting (arrow F2 in FIG. 3*c*) so that said arm 3 returns to its initial vertical position.

It then suffices for the user to put the locking means back into place.

By way of example, the vertical stand 1 can be 3 meters (m) tall while the arm 3 can have a total length of 5 m, i.e. 2.50 m on either side of the hinge axis.

An Antenna Mast Having a Control Hinge

Other variant embodiments of the invention are described below with reference to FIG. 4 et seq.

In the antenna mast structure shown in these Figures, the arm 3 carried by the vertical stand 1 extends substantially in one direction only from its pivot axis 4.

In order to enable a user firstly to control tilting of the arm 3 and secondly to return the arm easily to its vertical position, a hinged linkage 13 is also provided together with a retaining cable 14 which the user secures to said linkage in order to control tilting of the arm.

More precisely, the linkage 13 comprises two elements 13*a* and 13*b* which are pivoted to each other, the element 13*a* being also hinged to pivot on the arm 3 while the element 13*b* is hinged to pivot on a fork 15 in the vicinity of the mast stand 1. As will have been understood, the various pivot axes of the two elements 13*a* and 13*b* are parallel to the axis 4.

Figure 8:
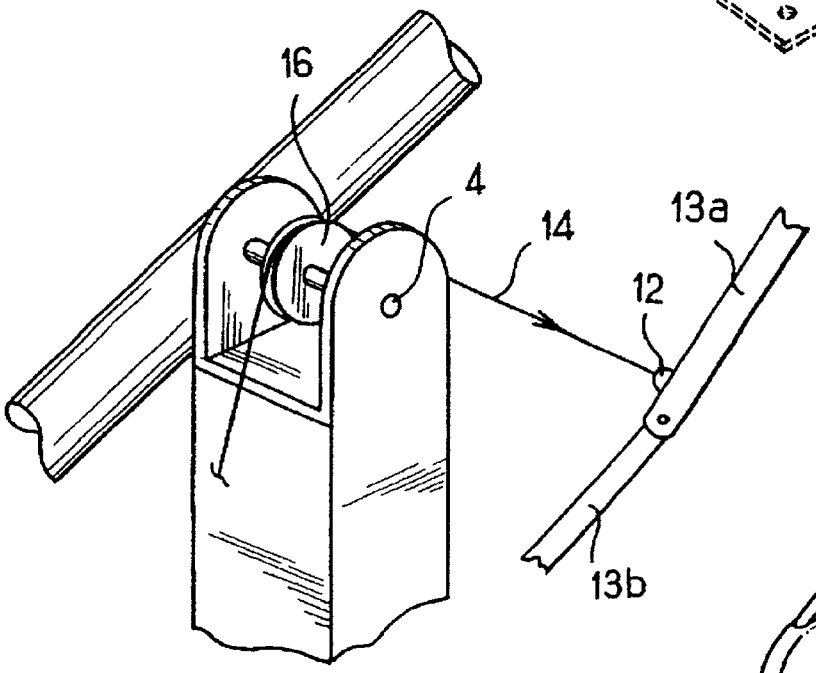
FIG. 8 shows a detail of how a winder and unwinder is used in the FIG. 5 variant.

A loop 12 is also provided on the element 13*a* close to its hinge with the element 13*b* and the retaining cable 14 is fixed to the loop (FIG. 8).

The cable 14 passes over a pulley wheel mounted to rotate relative to a fork at the top of the mast stand 1.

At its end remote from the loop 12, the retaining cable 14 has means for fixing to a winder and unwinder 19 (FIG. 9) enabling the user to control tilting of the arm 3 and to raise it.

Additional safety means are also provided to prevent the arm from tilting suddenly if the retaining cable is not in place. The safety means are permanently installed.

Thus, work is performed on such a mast with a linkage, as follows.

The user disengages the locking means holding the arm in its vertical position where it extends the mast stand.

Figure 4:
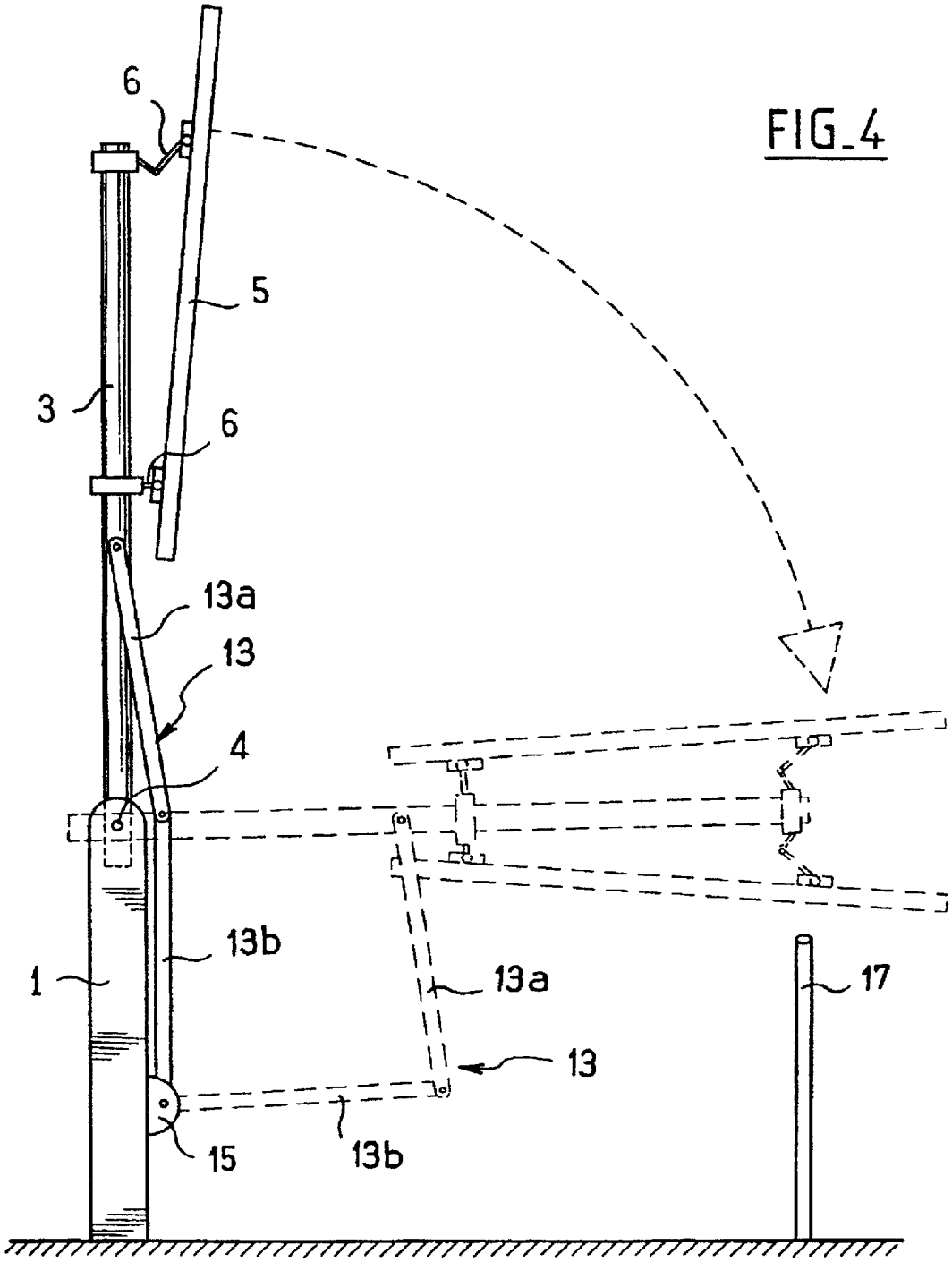
FIGS. 4 and 5 are diagrammatic side views of masts constituting another variant (variant having a control linkage), one in which the hinged arm is single and centered on its mast stand (FIG. 4), the other having two hinged arms situated on either side of the mast stand (FIG. 5)
Figure 5:
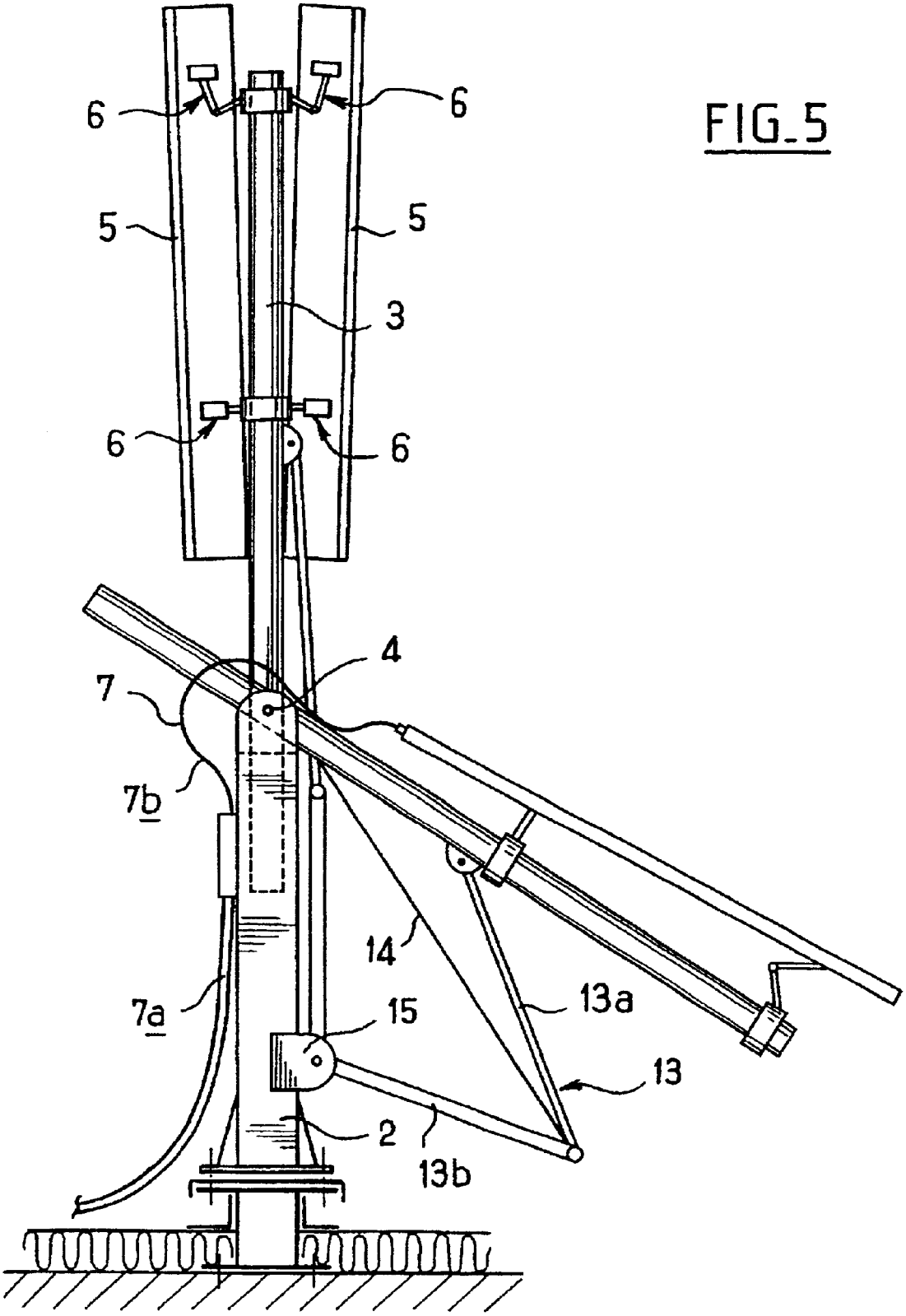
Figure 6:
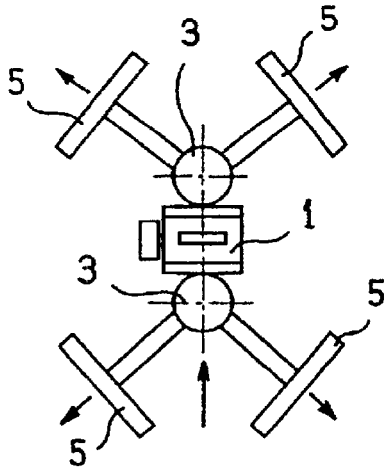
FIG. 6 is a plan view showing the structure of FIG. 5.
Figure 7:
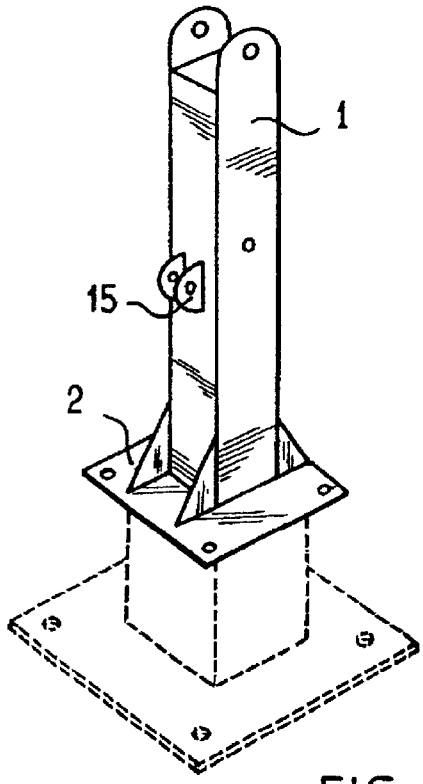
FIG. 7 is a diagram of a mast stand of the type shown in FIGS. 4 to 6.

The arm then tends on its own, under the force of gravity, to tilt into the positions shown in FIGS. 4 and 5.

Figure 9:
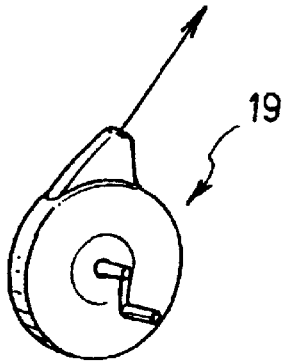
FIG. 9 is a diagram of a winder and unwinder used in a structure of the type shown in FIGS. 5 to 8.

The user controls this tilting by using the unwinder means 19 (FIG. 9).

End-of-stroke abutments can be provided to prevent the hinged arm from moving down below a given position.

The antennas 5 carried by the arm 3 that have been caused to tilt are then at a level enabling the user to work on said antennas in complete safety, with a guard rail at a height of about 1 meter above the platform on which the antenna mast is mounted then sufficing (cf. collective protective guard rail 17 in FIG. 4).

Once work has been completed, the user raises the arm 3 using the unwinder/winder 19 (FIG. 9) and replaces the locking means once the vertical position has been reached.

Other retaining devices enabling the tilting of the arm to be slowed and making the arm easier to raise could be envisaged as a replacement for the cable 14 or for the counterweight system (spring, hydraulic dampers, actuators).

What is claimed is:

1. A relay antenna mast for a cellular radio telecommunications system, the relay antenna mast comprising:

a mast stand (1);

at least one arm (3) pivotally mounted on said mast stand (1) and carrying at least one antenna of a cellular radio-telecommunication system (5);

means for locking said arm in a position in which the antenna(s) is/are in a high position; and a linkage comprising two elements (13*a*, 13*b*) fixed one to the mast stand (1) and the other to the arm, one (13*a*) of the elements carrying means (12) for fixing a retaining device (14) enabling the operative to control tilling of the arm, said arm (3) being suitable, when said locking means are disengaged, for being tilted about its pivot axis (4) to a position in which at least one antenna is at a height enabling it to be worked on by an operative at the foot of the mast.

2. A mast according to claim 1, characterized in that the arm (3) extends on either side of its pivot axis (4) and carries counterweight-forming means (8) on its branch opposite from its branch carrying the antenna(s).

3. A mast according to claim 2, characterized in that the counterweight-forming means (8) are adjustable in mass and/or in translation along the arm.

4. A mast according to claim 1, characterized in that the retaining device (14) is a removable device put into place by the operative prior to releasing the locking means, and subsequently removed once the locking means have been re-engaged after work has been carried out.

5. A mast according to claim 4, characterized in that it comprises a plurality of arms (13*a*, 13*b*) pivotally mounted on a common mast stand.

6. A mast according to claim 5, characterized in that an arm carries a plurality of antennas.

7. A platform for a relay antenna mast in a cellular radio telecommunications system for use in an urban area, the platform comprising a relay antenna mast and a protective guard rail, and being characterized in that the antenna mast is a mast according to claim 1.

8. A platform according to claim 7, characterized in that the antenna mast and the guard rail are carried on the top of a building.

9. A relay antenna mast for a cellular radio telecommunications system, the relay antenna mast comprising:

a mast stand (1);

at least one arm (3) pivotally mounted on said mast stand (1) and carrying at least one antenna of a cellular radio-telecommunication system (5);

means for locking said arm in a position in which the antenna(s) is/are in a high position; and a plurality of linkage elements (13*a*, 13*b*) pivotally mounted independent from one another on the mast stand;

said at least one arm (3) being suitable, when said locking means are disengaged, for being tilted about its pivot axis (4) to a position in which at least one antenna is at a height enabling it to be worked on by an operative at the foot of the mast.

* * * * *

UNITED STATES PATENT AND TRADEMARK OFFICE

CERTIFICATE OF CORRECTION

PATENT NO. : 6,809,702 B2
DATED : October 26, 2004
INVENTOR(S) : Safakhah

It is certified that error appears in the above-identified patent and that said Letters Patent is hereby corrected as shown below:

Column 4,
Line 61, please delete "the relay antenna mast comprising" and insert -- the relay antenna mast comprising --.

Column 6,
Line 22, please delete "tilted" and insert -- tilting --.

Signed and Sealed this

Twenty-third Day of August, 2005

JON W. DUDAS
*Director of the United States Patent and Trademark Office*